United States Patent [19]

Morrison et al.

[11] Patent Number: 5,007,580

[45] Date of Patent: Apr. 16, 1991

[54] FOLDABLE CONTAINER

[75] Inventors: Wayne P. Morrison, 950 Raco Dr., Ste. A, Lawrenceville, Ga. 30245; Neil T. Castleberry, St. Augustine, Fla.

[73] Assignee: Wayne P. Morrison, Lawrenceville, Ga.

[21] Appl. No.: 482,523

[22] Filed: Feb. 21, 1990

[51] Int. Cl.[5] ..... B65D 5/20

[52] U.S. Cl. ..... 229/117.17; 229/150; 229/193

[58] Field of Search ..... 229/117.17, 150, 178, 229/193, 194

[56] References Cited

U.S. PATENT DOCUMENTS

| | | | |
|---|---|---|---|
| 2,465,324 | 3/1949 | Mian | 229/117.17 |
| 2,731,191 | 1/1956 | Layne | 229/117.17 |
| 2,811,296 | 10/1957 | Long | 229/194 |
| 3,014,633 | 12/1961 | Tarmina | 229/178 |
| 3,301,461 | 1/1967 | Kroeschell | 229/178 |
| 3,843,040 | 10/1974 | Locke | 229/193 |
| 3,854,651 | 12/1974 | Osborne | 229/178 |
| 3,924,801 | 12/1975 | Partain | 229/178 |
| 3,933,300 | 1/1976 | Dempster | 229/178 |
| 3,973,723 | 8/1976 | Owens | 229/178 |
| 3,998,379 | 12/1976 | Myers et al. | 229/178 |
| 4,197,980 | 4/1980 | Johnson | 229/178 |
| 4,257,550 | 3/1981 | Frohlicher | 229/178 |
| 4,265,391 | 5/1981 | Zornes et al. | 229/178 |
| 4,316,563 | 2/1982 | Turner et al. | 229/178 |
| 4,372,476 | 2/1983 | Harned et al. | 229/178 |

FOREIGN PATENT DOCUMENTS

| | | | |
|---|---|---|---|
| 583870 | 9/1959 | Canada | 229/117.17 |
| 54093 | 6/1982 | European Pat. Off. | 229/150 |
| 2615482 | 11/1988 | France | 229/117.17 |

*Primary Examiner*—Gary E. Elkins

*Attorney, Agent, or Firm*—Thomas C. Saitta

[57] ABSTRACT

A container constructed from a cut and scored foldable blank of cardboard or similar material, the blank having a top wall, a back wall, a bottom wall and a front wall, all connected by score lines. A pair of outer side walls are connected to each end of the back wall and a pair of middle side walls are connected to each end of the front wall by score lines. A pair of bottom panels and a pair of inner side walls are connected to opposite sides of the outer side walls by score lines. All adjacent score lines or cut lines are offset relative to each other, each line terminating in one of a number of angle slits.

7 Claims, 2 Drawing Sheets

FOLDABLE CONTAINER

BACKGROUND OF THE INVENTION

The invention relates generally to the field of foldable containers, and more particularly to the field of foldable containers made from planar paperboard or cardboard stock material. The folded container forms a rectangular box having a closeable lid, three-layer side walls and a two-layer bottom. When formed from corrugated cardboard stock, the flutes will be vertical in all three layers of the side walls and will run perpendicularly between the two layers of the bottom.

Containers of this type are known in the art. The containers are designed for use in situations where the contained items are relatively heavy and where stacking of the loaded containers is anticipated. Thus the two-layer bottom and three-layer side walls are desirable structural features. The containers are made by folding a pre-cut and pre-scored cardboard blank. The particular size and location of the panels, slits and score lines determine the ultimate shape and size of the container. The particular relationship among these components determines the ultimate ease of construction and overall strength of the completed container. Examples of similar containers are shown in Tarmina U.S. Pat. No. 3,014,633 and Osborne U.S. Pat. No. 3,854,651.

The known containers of the type suffer from problems of both oversight and over-design. The invention simplifies the overall design for ease of manufacture and construction, while requiring certain features which result in maximum strength and durability in the completed container. In particular, emphasis is directed to the corners and intersection points of the various wall panel members, where angular slits are provided to preclude tearing of the wall panels as well as to maintain precise alignment and interfitting among the wall members making up the multi-layer walls. The particular size and shape relationships of the different wall panel members is also defined so as to maintain the alignment and interfitting of these panels and to create a container of the highest strength and durability.

BRIEF SUMMARY OF THE INVENTION

The invention is a foldable container constructed from a pre-slit and prescored planar blank. Preferably, the blank is a paperboard or cardboard stock material, and even more preferably is corrugated cardboard. The blank is structured to have a top wall, a back wall, a bottom wall and a front wall, all substantially rectangular and all connected in series by parallel score lines. Score lines are lines inscribed in the surface of the blank material to facilitate folding, where such lines do not form complete cuts through the material. A pair of outer side walls are connected to each end of the back wall and a pair of middle side walls are connected to each end of the front wall by score lines. A pair of inner side walls are connected by double score lines to each of the outer side walls and are separated by slits from each end of the top wall. A pair of bottom panels are connected by score lines to each of the outer side walls and separated by slits from each end of the bottom wall. The score lines and slits are positioned such that no adjacent score line or slit is on the same line, i.e., such that each score line or slit is offset from any adjacent score line or slit. This is accomplished at the intersections of the top wall and back wall, back wall and bottom wall, and bottom wall and front wall, by angle slits. The angle slits create different dimensions between the adjacent wall members, resulting in precise interfitting of the different components when the container is constructed.

DETAILED DESCRIPTION OF THE INVENTION

The invention comprises a container made of any suitable material which can be cut and folded, but preferably made from paperboard or corrugated cardboard stock. The invention is structured such that a cut and scored blank may be manufactured from the planar stock material, and the container constructed by folding the various walls and panels in a prescribed manner. The resulting container is self-maintaining without need of adhesive or mechanical fasteners. The container is also self-reinforcing, having triple panel side walls and a double panel bottom. For corrugated cardboard stock, the blank is cut such that the corrugation flutes will be vertical in the front wall, back wall and all three side wall panels upon folding the blank to form the container, and further that the corrugation flutes of the bottom wall are perpendicular to the corrugation flutes of the other panel layer of the bottom. For ease of description, the two primary directions will be designated as longitudinal and lateral. Longitudinal, as used herein, shall refer to the direction from the top wall to the front wall in the unfolded configuration, with lateral being the direction perpendicular to this direction.

Figure 1:
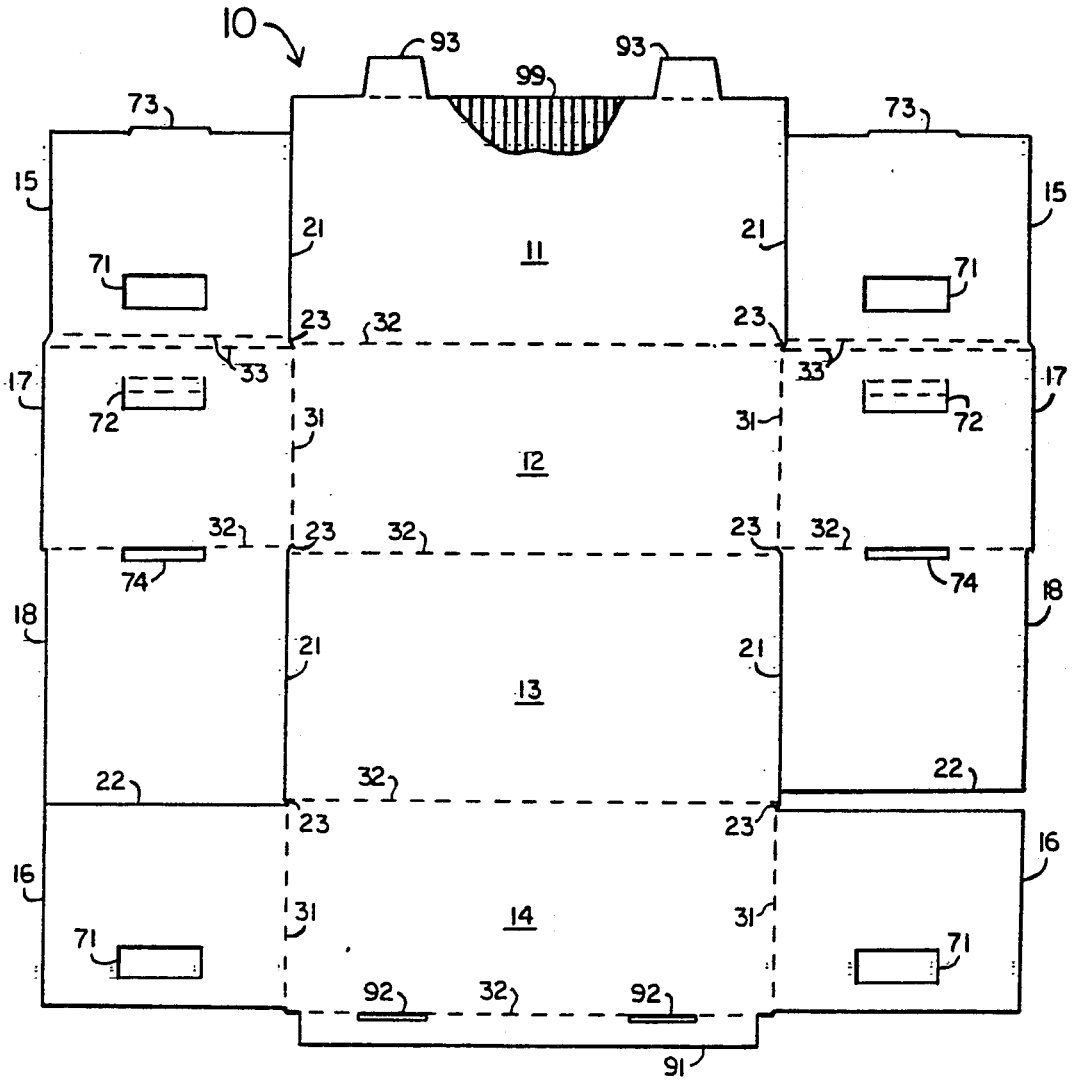
FIG. 1 is a view of the unfolded blank from which the container is constructed.

With reference to FIG. 1, the invention is shown in the unfolded state. The blank 10 is cut from a planar stock material. If corrugated cardboard is the stock material, as is preferable, the blank 10 is cut so that the flutes 99 run parallel to the longitudinal direction, as seen in the cut-away portion of the figure. The blank 10 is cut completely through to form longitudinal slits 21, lateral slits 22, angle slits 23 and apertures. Longitudinal slits 21 are parallel to the direction of the flutes 99 and lateral slits 22 are perpendicular to the flutes 99. The blank 10 is also scored to form longitudinal score lines 31 parallel to the direction of the flutes 99 and lateral score lines 32 perpendicular to the flutes 99. The score lines are not cut completely through the blank 10 and enable the blank 10 to be easily folded along the score lines. The container comprises a top wall 11, back wall 12, bottom wall 13 and front wall 14. Top wall 11 is connected by a lateral score line 32 to back wall 12, back wall 12 is connected by a lateral score line 32 to bottom wall 13, and bottom wall 13 is connected by a lateral score line 32 to front wall 14. A pair of middle side walls 16 is connected to the opposite lateral ends of front wall 14 by longitudinal score lines 31. A pair of outer side walls 17 is connected to the opposite lateral ends of back wall 12 by longitudinal score lines 31. A pair of inner side walls 15 is connected to the outer side walls 17 by double score lines 33 of non-equal length, such that the score line adjacent the outer side walls is longer than the score line adjacent the inner side walls, these double score lines 33 running parallel to lateral score lines 32. The inner side walls 15 are separated from the lateral ends of top wall 11 by longitudinal slits 21. A pair of bottom panels 18 is connected by lateral score lines 32 to the outer side walls 17, on the side opposite from the inner side walls 15. The bottom panels 18 are separated from the lateral ends of bottom wall 13 by longitudinal slits 21. The bottom panels 18 are separated from the middle side walls 16 by lateral slits 22. This separation may be as small as the slit itself or the gap may be large, as shown in the figure. A lid flap 91 is connected to front wall 14 by lateral score lines 32. Lid flap 91 contains tab slots 92 positioned to receive tabs 93, which are connected by a lateral score line 32 to top wall 11. Tabs 93 are inserted into tab slots 92 to fasten the top wall 11 onto the completed container.

The blank 10 further comprises grip flap apertures 71 which are substantially rectangular openings cut into inner side walls 15 and middle side walls 16. Grip flaps 72 are formed in outer side walls 17 by three slits and two score lines. The grip flap apertures 71 and grip flaps 72 are positioned so as to align when the inner side walls 15, middle side walls 16 and outer side walls 17 are in place in the folded configuration. Grip flap 72 is then bent on the score lines and pushed through the grip flap apertures 15 in middle side walls 16 and inner side walls 15, forming a comfortable grip for carrying the container as well as providing another fastening means to maintain the structure of the container. Wall tab slots 74 are cut in the bottom panels 18 adjacent the lateral score line 32 connecting the bottom panels 18 to the outer side walls 17. Wall tabs 73 extend from the longitudinal edge of the inner side walls and are positioned to correspond to the wall tab slots 72 when the side walls are in place in the folded configuration. The wall tabs 73 and wall tab slots 74 act to lock the inner side walls 15 in place within the container, thereby maintaining the middle side walls 16 in place between the inner side walls 15 and outer side walls 17.

While it is of course foreseeable that the container may be of any size, for precise construction of the container in the folded configuration, certain relationships must be maintained with regard to relative dimensions. The fact that certain members will be internal to the container or contained within other components of the container, while still others will be exterior, must be accounted for. The lateral dimension of the two bottom panels must be less than the longitudinal dimension of the bottom panel 13. The combined longitudinal dimensions of the bottom panels 18 must be less than the lateral dimension of the bottom wall 13 or else the bottom panels 18 will overlap. This is accomplished by shortening one or both of the bottom panels 18 in the longitudinal dimension. In FIG. 1, only one bottom panel 18 is shortened, while in FIG. 4, both bottom panels 18 are shortened by creating a large gap at lateral slits 22. The lateral dimension of the middle side walls 16 must be less than the longitudinal dimension of the bottom wall 13. The longitudinal dimension of the middle side walls 16 must be less than the longitudinal dimension of the outer side walls 17 and the inner side walls 15. The lateral dimension of the inner side walls 15 and bottom panels 18 must be less than the lateral dimension of the outer side walls 17. The lateral dimension of the back wall 12 and front wall 14 must be less than the lateral dimension of the bottom wall 13 and the top wall 11. The separation distance of the double score lines 33 should match or be slightly greater than the thickness of the middle side walls 16.

Because of these dimensional requirements, the various score lines and slits of the blank 10 never align to create a single straight line. All lateral score lines 32 and lateral slits 22 between adjacent individual wall or panel members are slightly offset. Likewise, all longitudinal score lines 31 and longitudinal slits 21 between adjacent individual wall or panel members are slightly offset. With reference to FIG. 1 it is seen that the lateral score lines 32 between the top wall 11, back wall 12, bottom wall 13 and front wall 14 do not align with the double score lines 33 between the inner side walls 15 and outer side walls 17, the lateral score lines 32 between the bottom panels 18 and outer side walls 17, and the lateral slits 22 between the middle side walls 16 and bottom panels 18, respectively. Furthermore, the longitudinal slits 21 between the bottom wall 13 and bottom panels 18 do not align with either the longitudinal score lines 31 between the front wall 14 and middle side walls 16 or the longitudinal score lines 31 between the back wall 12 and the outer side walls 17. Likewise, the longitudinal slit 21 between the top wall 11 and the inner side walls 15 do not align with the longitudinal score lines 31 between the back wall 12 and the outer side walls 17.

To accomplish these dimensional requirements and offsets structurally, it is necessary to incorporate a number of angle slits 23 at the intersections of the offset slits and score lines. Specifically, a pair of angle slits 23 join the longitudinal slits 21 between the top wall 11 and inner side walls 15 to the longitudinal score lines 31 between the back wall 12 and the outer side walls 17. These angle slits 23 run between the double score lines 33 and create the lesser lateral dimension of the back wall 12 relative to the top wall 11, as well as the lesser lateral dimension of the inner side walls 15 relative to the outer side walls 17. Another pair of angle slits 23 join the longitudinal slits 21 between the bottom wall 13 and the bottom panels 18 to the longitudinal score lines 31 between the back wall 12 and outer side walls 17. These angle slits create the lesser lateral dimension of the back wall 12 relative to the bottom wall 13, as well as the lesser lateral dimension of the bottom panels 18 relative to the outer side walls 17. A third pair of angle slits join the longitudinal slits 21 between the bottom wall 13 and the bottom panels 16 to the longitudinal score lines 32 between the front wall 14 and the middle side walls 16. These angle slits create the lesser lateral dimension of the front wall 14 relative to the bottom wall 13. The various angle slits 23 also act to create the offset between the double score lines 33 and the lateral score line 32 connecting the top wall 11 and the back wall 12, the offset between the lateral score line 32 connecting the back wall 12 and bottom wall 13 and the lateral score lines 32 between the outer side walls 17 and bottom panels 18, and the offset between the lateral score line 32 connecting the front wall 14 and the bottom wall 13 and the lateral slits 22 between the middle side walls 16 and bottom panels 18. Additionally, the outer cut line for each of the double score lines 33 is at an angle. This creates the smaller lateral dimension of the inner side walls 15 relative to the lateral dimension of the outer side walls 17, so that the edges of the outer side walls 17 will match up to the edges of the front wall 14 and back wall 12 when the container is constructed, while allowing the inner side walls 15 to fit snugly between the front wall 14 and back wall 12 in the interior of the folded container.

Figure 2:
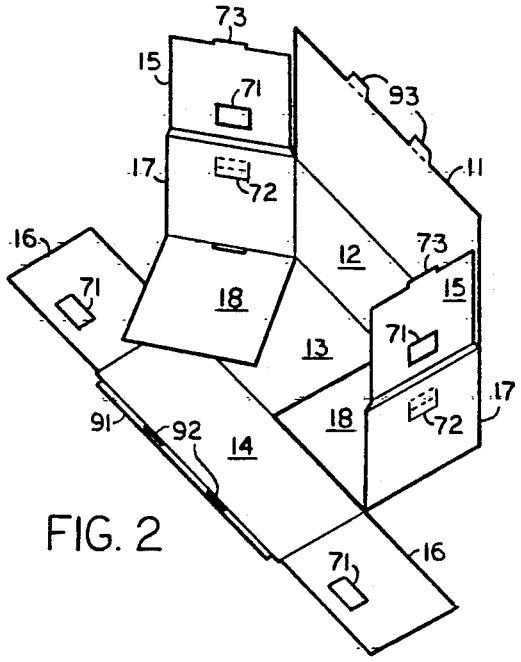
FIG. 2 is a perspective view of the container as partially constructed from the blank.
Figure 3:
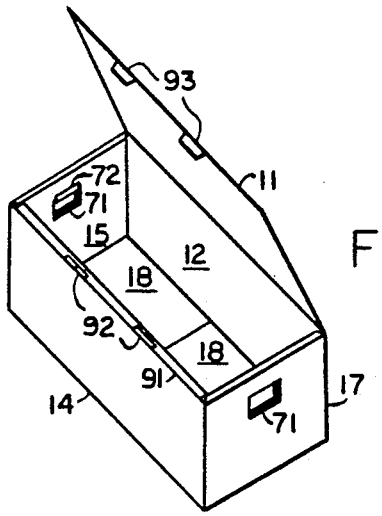
FIG. 3 is a perspective view of the completed container.

With reference now to FIGS. 2 and 3, the folded container is illustrated. To construct the container from the blank 10, back wall 12 is brought perpendicular to bottom wall 13 by folding along lateral score line 32. Bottom panels 18 are brought together to meet each other in the interior above bottom wall 13 by folding the outer side walls 17 perpendicular to back wall 12. Middle side walls 16 are folded inward along the longitudinal score line 31 and front wall 14 is folded perpendicular to bottom wall 13 by folding along lateral score line 32. The middle side walls 16 are now positioned adjacent and parallel to outer side walls 17 and inner side walls 15 are folded along double score lines 33 into the interior of the container to cover middle side walls 16, and wall tabs 73 are inserted into wall tab slots 18. Grip flaps 72 are now pushed through the grip flap apertures 71 in the middle side walls 16 and inner side walls 15. The middle side walls 16 are now securely held in place between the outer side walls 17 and the inner side walls 15 by the grip flaps 72 and wall tabs 73. To close the container, the top wall 11 is brought forward onto the front wall 14 and the tabs 93 ar inserted into the tab slots 92 on the lid flap 91. The top wall can be opened and closed at will.

The resulting container is maintained structurally by the interlocking and inter-folding features of the construction and no outside fasteners or adhesives are required. The container has a double layer bottom consisting of the bottom wall 13 and the two bottom panels 18, with the flutes 99 of the bottom wall running perpendicularly to the flutes 99 for increased strength. The side walls consist of the inner side walls 15, the middle side walls 16 and the outer side walls 17, with the flutes 99 of each of these running vertically to provide increased vertical strength. The front wall 14 and back wall 12 also have flutes 99 running vertically. This is especially significant for situations where the containers are to be stacked.

Figure 4:
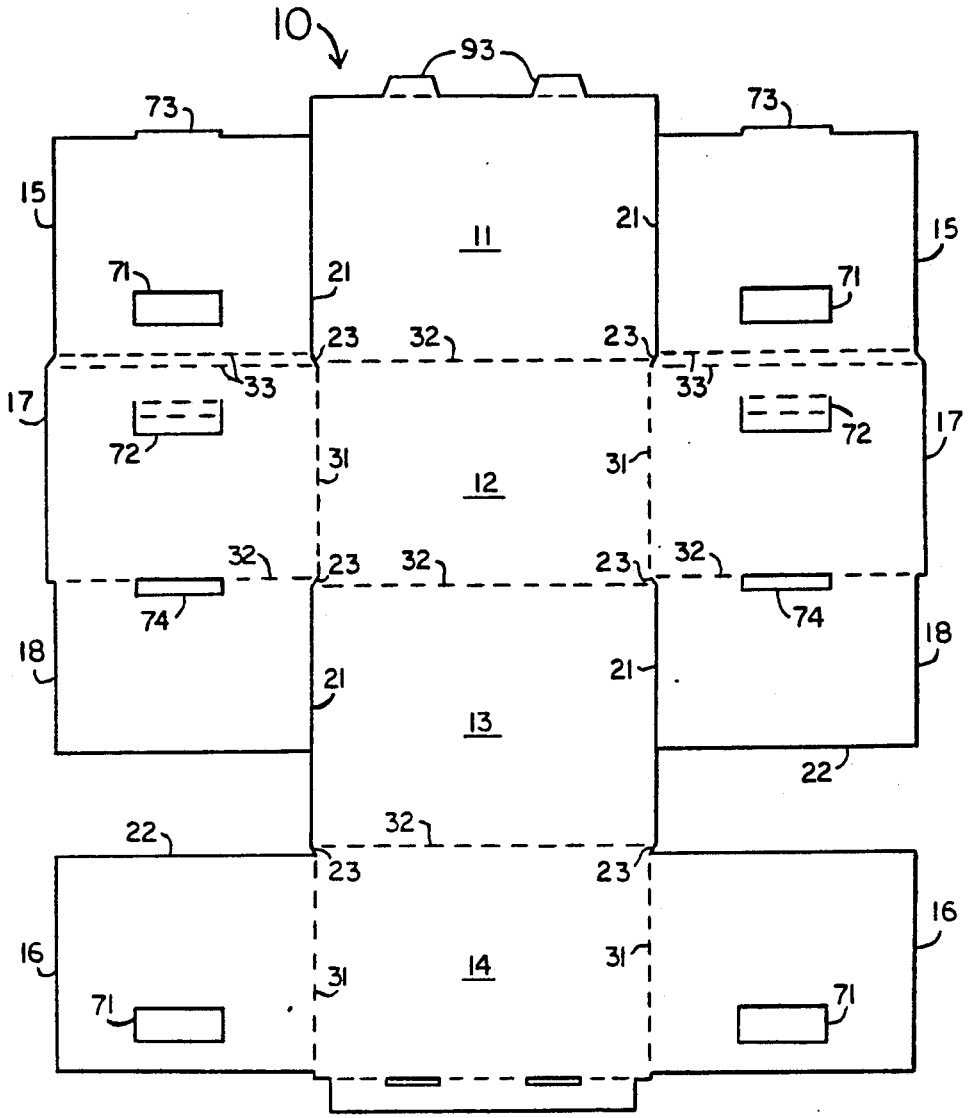
FIG. 4 is a view of an unfolded blank for an alternative embodiment of the container.

As shown in FIG. 4, the ultimate dimensions of the completed container are a matter of choice. The blank 10 shown in this figure maintains the required dimensional relationships between the various members of the construction, and in particular comprises the angle slits 23 and offset slits and score lines as above described, but the resulting container will have different dimensions. In this example, the overall lateral dimension of the blank 10 in FIG. 4 is shorter than that of the blank 10 in FIG. 1, such that the lateral dimensions of the top wall 11, back wall 12, bottom wall 13 and front wall 14 are shorter and the longitudinal dimension of bottom panels 18 is shorter in FIG. 4 than in FIG. 1, but all other dimensions are the same. The resulting container of FIG. 4 will have the same height and depth as the container of FIG. 1, but will be shorter in lateral length. The bottom panels 18 must be shortened in the longitudinal direction to account for the shortened lateral dimension of the bottom wall 13.

It is to be understood that the above illustrations and embodiments are by way of example only, and the true definition and scope of the invention is as set forth in the following claims. It is contemplated that certain modifications and substitutions may be made within the scope of the claims without departing from the spirit of the invention.

I claim:

1. A container formed from a cut and scored foldable blank of cardboard, said blank having a longitudinal direction and a lateral direction, comprising in combination:

(A) a top wall, a back wall, a bottom wall and a front wall, where said top wall is connected to said back wall by a lateral score line, said back wall is connected to said bottom wall by a lateral score line, and said bottom wall is connected to said front wall by a lateral score line, where the lateral dimension of said back wall and said front wall is less than the lateral dimension of said bottom wall and said top wall;

(B) a pair of middle side walls connected to said front wall by a pair of longitudinal score lines, where the lateral dimension of said middle side walls is less than the longitudinal dimension of said bottom wall;

(C) a pair of outer side walls connected to said back wall by a pair of longitudinal score lines, where the longitudinal dimensions of said outer side walls is greater than the longitudinal dimensions of said middle side walls;

(D) a pair of inner side walls connected to said outer side walls by a pair of double score lines of non-equal length, where said inner side walls are separated from said top wall by a pair of longitudinal slits, where the lateral dimension of said inner side wall is less than the lateral dimension of said outer side walls, and where the longitudinal dimension of said inner side walls is greater than the longitudinal dimension of said middle side walls;

(E) a pair of bottom panels connected to said outer side walls by a pair of lateral score lines, and where said bottom panels are separated from said bottom wall by a pair of longitudinal slits, and where said bottom panels are separated from said middle side walls by a pair of lateral slits, and where the sum of the longitudinal dimension of both said bottom panels is less than the lateral dimension of said bottom wall, and further where the lateral dimension of said bottom panels is less than the longitudinal dimension of said bottom wall;

(F) a pair of angle slits connecting said longitudinal slits separating said top wall from said inner side walls to said longitudinal score lines connecting said back wall to said outer side walls, another pair of angle slits connecting said longitudinal score lines connecting said back wall to said outer side walls to said longitudinal slits separating said bottom wall from said bottom panels, and still a third set of angle slits connecting said longitudinal slits separating said bottom wall from said bottom panels to said longitudinal score lines connecting said front wall to said middle side walls.

2. The device of claim 1, further comprising:

(G) a lid flap connected to said front wall by a lateral score line, said lid flap containing one or more tab slots;

(H) one or more tabs connected to said top wall, whereby said tabs align with said tab slots when said blank is folded to form said container.

3. The device of claim 1, further comprising:

(I) a grip flap positioned in each of said outer side walls, said grip flaps being formed of three connected slits and two score lines;

(J) a grip flap aperture positioned in each of said inner side walls and middle side walls, whereby said grip flap apertures align with said grip flaps when said blank is folded to form said container.

4. The device of claim 1, further comprising:

(K) wall tab slots cut in said bottom panels adjacent said lateral score lines connecting said bottom panels to said outer walls;

(L) wall tabs extending from said inner side walls, where said wall tabs align with said wall tab slots when said blank is folded to form said container.

5. The device of claim 1, where each of said double score lines of non-equal length is comprised of a lateral score line adjacent said outer side wall and a lateral score line adjacent said inner side wall, where said lateral score line adjacent said outer side wall is greater in length than said lateral score line adjacent said inner side wall.

6. The device of claim 1, where said lateral slits separating said bottom panels from said middle side walls are of differing widths.

7. The device of claim 1, where said blank is made of corrugated cardboard containing flutes, and the flutes of said corrugated cardboard are parallel to the longitudinal direction.

* * * * *